US010036110B2

(12) United States Patent
Kim et al.

(10) Patent No.: US 10,036,110 B2
(45) Date of Patent: Jul. 31, 2018

(54) VIBRATION LIMITER OF WASHING MACHINE

(71) Applicant: LG Electronics Inc., Seoul (KR)

(72) Inventors: Youngjun Kim, Seoul (KR); Youngjong Kim, Seoul (KR); Insik Yu, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 998 days.

(21) Appl. No.: 13/970,183

(22) Filed: Aug. 19, 2013

(65) Prior Publication Data

US 2014/0047870 A1 Feb. 20, 2014

(30) Foreign Application Priority Data

Aug. 20, 2012 (KR) ..... 10-2012-0090770

(51) Int. Cl.
*D06F 37/20* (2006.01)

(52) U.S. Cl.
CPC ..... *D06F 37/203* (2013.01)

(58) Field of Classification Search
CPC ..... D06F 37/20; D06F 37/22; D06F 37/24; D06F 49/06
See application file for complete search history.

(56) References Cited

U.S. PATENT DOCUMENTS 4,513,473 A * 4/1985 Omata ..... E05F 3/14 16/82
7,340,925 B2 3/2008 Kim et al.
2004/0227439 A1* 11/2004 Salice ..... E05F 5/006 312/333
2007/0006393 A1 1/2007 Ishida et al.

FOREIGN PATENT DOCUMENTS

EP 0531917 3/1993
JP 57-29840 2/1982
KR 20-1998-0018507 7/1998

* cited by examiner

*Primary Examiner* — David Cormier
(74) *Attorney, Agent, or Firm* — Dentons US LLP

(57) ABSTRACT

A vibration limiter of a washing machine is disclosed. The vibration limiter includes a housing installed at one of a cabinet and a tub, a contact plate disposed within the housing such that the contact plate comes into contact with the other of the cabinet and the tub when the tub vibrates, a spring for elastically supporting the contact plate, a rotating member rotatable by at least one of the spring and the contact plate, and an oil damper engaged with the rotating member. The oil damper complementarily acts with the spring, to effectively absorb vibration. Accordingly, it is possible to reduce the size of the spring and to secure enhanced reliability even after prolonged use.

18 Claims, 7 Drawing Sheets

VIBRATION LIMITER OF WASHING MACHINE

CROSS-REFERENCE TO RELATED APPLICATION

This application claims the priority benefit of Korean Patent Application No. 10-2012-0090770 filed on Aug. 20, 2012 in the Korean Intellectual Property Office, the disclosure of which is incorporated herein by reference.

BACKGROUND OF THE INVENTION

1. Field of the Invention

The present invention relates to a vibration limiter of a washing machine, and more particularly to a vibration limiter of a washing machine, which is capable of limiting excessive vibration of a tub when the tub vibrates.

2. Description of the Related Art

Generally, a washing machine is an apparatus for treating laundry such as clothes or bedclothes, using detergent-dissolved water or clean water, through processes such as washing, rinsing, and spin-drying in order to remove contaminants attached to the laundry.

Such a washing machine may include a cabinet formed with a laundry entrance while defining an appearance of the washing machine, a tub disposed within the cabinet, to receive wash water, a wash tub rotatably disposed within the tub, and a driving mechanism for rotating the wash tub.

The tub may be installed within the cabinet by support means such as hangers to connect the tub and cabinet. The tub may be joggled within the cabinet due to vibration generated during rotation of the wash tub.

When excessive vibration of the tub occurs, the tub may strike the cabinet. When the number of strikes or the level of strikes is excessive, the washing machine may shift from an original position thereof. Excessive noise may also be generated due to striking.

A spring-loaded anti-vibrator (or vibration limiter) may be installed within the washing machine, in addition to the support means. Such an anti-vibrator may be installed to allow the tub to direct contact the cabinet. Springs may absorb vibration generated during excessive vibration of the tub.

Patent Literature 1: Korean Utility Model Registration No. 20-0123527 (May 1, 1999).

In conventional anti-vibrators, springs have a large size because they alone should absorb impact during excessive vibration of the tub. Furthermore, the conventional anti-vibrator exhibits low reliability due to degradation in the tension of springs exhibited after prolonged use thereof.

SUMMARY OF THE INVENTION

Therefore, the present invention has been made in view of the above problems.

In accordance with an aspect of the present invention, the above and other objects can be accomplished by the provision of a vibration limiter of a washing machine including a housing installed at one of a cabinet and a tub, a contact plate disposed within the housing such that the contact plate comes into contact with the other of the cabinet and the tub when the tub vibrates, a spring for elastically supporting the contact plate, a rotating member rotatable by at least one of the spring and the contact plate, and an oil damper engaged with the rotating member.

The vibration limiter may further include a gap adjusting mechanism for adjusting a gap between the tub and the contact plate by rotating the rotating member.

The gap adjusting mechanism may be connected to a rotating shaft of the rotating member.

The vibration limiter may further include an unbalance sensor for detecting a position of at least one of the spring and the rotating member.

The housing may be formed with a round portion curved in a direction that the contact plate is bent by the tub.

The oil damper may be installed at the housing.

The contact plate may include a plate having opposite ends as a connecting end connected to the housing and a free end, and a damping member installed at one of the opposite ends of the plate facing the tub.

The buffering member may be installed to be closer to the free end than to the connecting end, at which the contact plate is connected to the housing.

The spring may include a torsion spring having opposite ends, one of the opposite ends being supported by the housing, the other of the opposite ends contacting the contact plate.

The rotating member may include a plate body formed, at an outer circumferential surface thereof, with gear teeth engaged with the oil damper, and a rotating shaft protruded from the plate body.

The torsion spring may be fixed to one of the plate body and the rotating shaft.

The vibration limiter may further include a spring casing disposed at the rotating member while being coupled to the contact plate, to protect the spring.

The housing may be formed with a through hole, through which the contact plate extends.

The contact plate may include a connecting rod connected to the rotating member, and a plate body disposed at the connecting rod.

The spring may extend from the plate body, to contact the housing.

The contact plate may further include a damping member installed at an end of the plate body facing the tub.

The housing may be installed to face a top of the tub.

The housing may be disposed between the tub and the cabinet, to be elongated in forward and rearward directions or in left and right directions.

The housing may be mounted to a hanger pivot mounted to the cabinet.

The vibration limiter may further include a level adjusting member disposed between the hanger pivot and the housing, to eliminate a level difference between the hanger pivot and the tub.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Reference will now be made in detail to preferred embodiments of the present invention, examples of which are illustrated in the accompanying drawings. These embodiments are not intended to limit the present invention. Other embodiments may also be provided.

Figure 1:
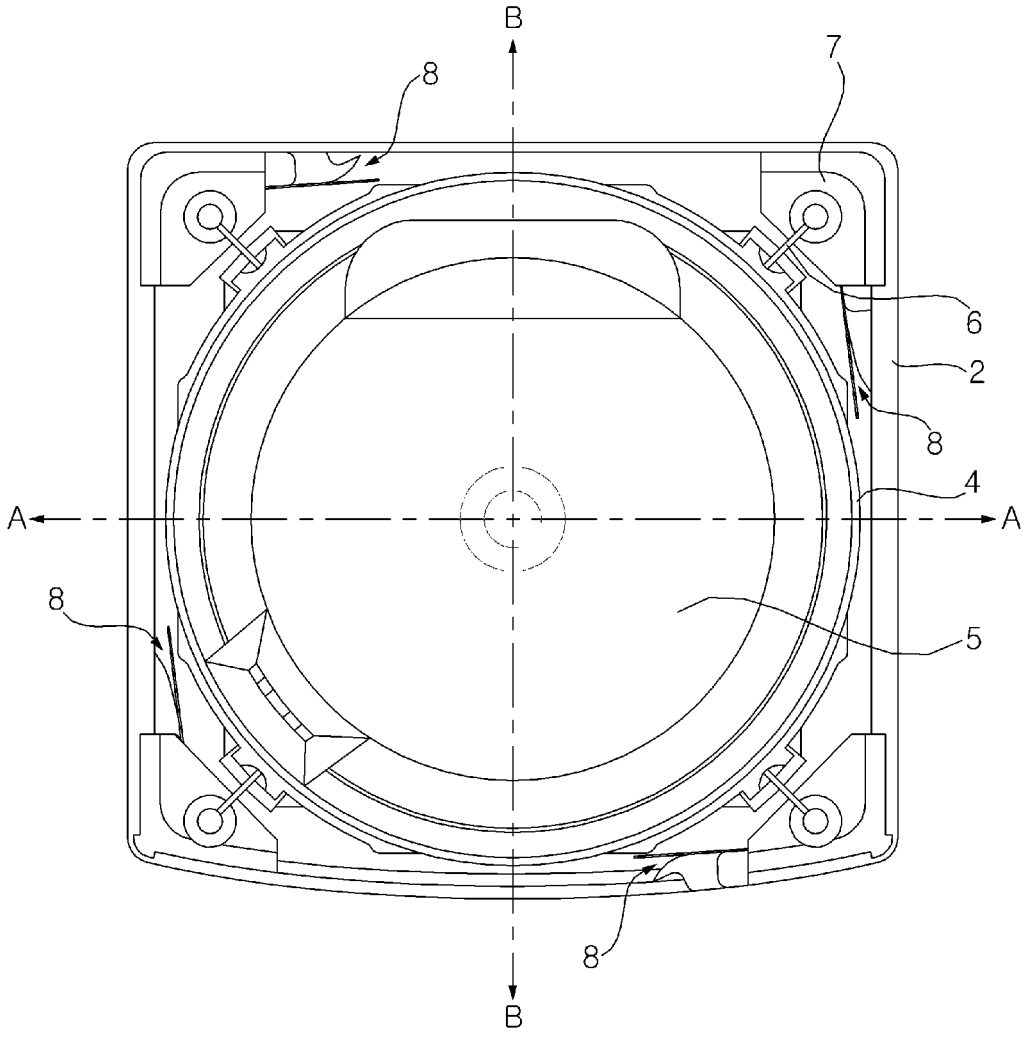
FIG. 1 is a plan view of a washing machine in which a vibration limiter according to an embodiment of the present invention is installed.

FIG. 1 is a plan view of a washing machine in which a vibration limiter according to an embodiment of the present invention is installed.

The washing machine illustrated in FIG. 1 may include a cabinet 2, which may define an appearance of the washing machine. A tub 4 may be supported by the cabinet 2 within the cabinet 2. The tub 4 may be an outer tub for containing wash water. A wash tub 5 (or inner tub), which contains laundry, may be rotatably disposed within the tub 4. A driving unit such as a motor to rotate the wash tub 5 may be installed within the tub 4. A laundry entrance may be formed at a top of the tub 4. Laundry may be loaded into or unloaded from the tub 4 through the laundry entrance. The tub 4 may be installed in the cabinet 2 in a hung state by hangers 6. Hanger pivots 7 may be installed in the cabinet 2, to support the hangers 6. The hanger pivots 7 may be mounted to four corners at the top of the cabinet 2, respectively. The level of each hanger pivot 7 from a bottom of the washing machine may be higher than a top of the tub 4. A vibration limiter 8 may be installed in the washing machine, to limit vibration of the tub 4. The vibration limiter 8 may be installed at one of the cabinet 2 and tub 4.

The vibration limiter 8 may be disposed between the cabinet 2 and the tub 4. When the vibration limiter 8 is installed at the cabinet 2, it may be maintained in a state of being spaced from the tub 4 when no vibration is generated. When the vibration limiter 8 is installed at the tub 4, it may be maintained in a state of being spaced from the cabinet 2 when no vibration is generated. When the vibration limiter 8 is installed at the cabinet 2, it may be directly mounted to the cabinet 2, or may be indirectly mounted to the cabinet 2 through mounting thereof to each hanger pivot 7. The vibration limiter 8 may limit horizontal vibration. The vibration limiter 8 may be installed in at least one of a region between a left wall of the cabinet 2 and the tub 4 and a region between a right wall of the cabinet 2 and the tub 4, to limit vibration in left and right directions A of the tub 4. The vibration limiter 8 may be installed in at least one of a region between a front wall of the cabinet 2 and the tub 4 and a region between a rear wall of the cabinet 2 and the tub 4, to limit vibration in forward and rearward directions B of the tub 4. The vibration limiter 8 may be installed in each of the region between the left wall of the cabinet 2 and the tub 4, the region between the right wall of the cabinet 2 and the tub 4, the region between the front wall of the cabinet 2 and the tub 4, and the region between the rear wall of the cabinet 2 and the tub 4. The vibration limiter 8 may include a left vibration limiter disposed at a left side of the tub 4, and a right vibration limiter disposed at a right side of the tub 4. When left and right vibration of the tub 4 occurs, the left vibration limiter and right vibration limiter may limit horizontal left and right vibration of the tub 4. The vibration limiter 8 may include a front vibration limiter disposed at a front side of the tub 4 with respect to the tub 4, and a rear vibration limiter disposed at a rear side of the tub 4 with respect to the tub 4. When forward and rearward vibration of the tub 4 occurs, the front vibration limiter and rear vibration limiter may limit horizontal forward and rearward vibration of the tub 4. The vibration limiter 8 may be installed at a level where the vibration limiter 8 faces the bottom of the tub 4 or at a level where the vibration limiter 8 faces the top of the tub 4. The vibration limiter 8 may be installed at a level where the vibration limiter 8 faces the top of the tub 4 in order to limit vibration generated at the top side of the tub 4 where relatively severe vibration occurs.

Figure 2:
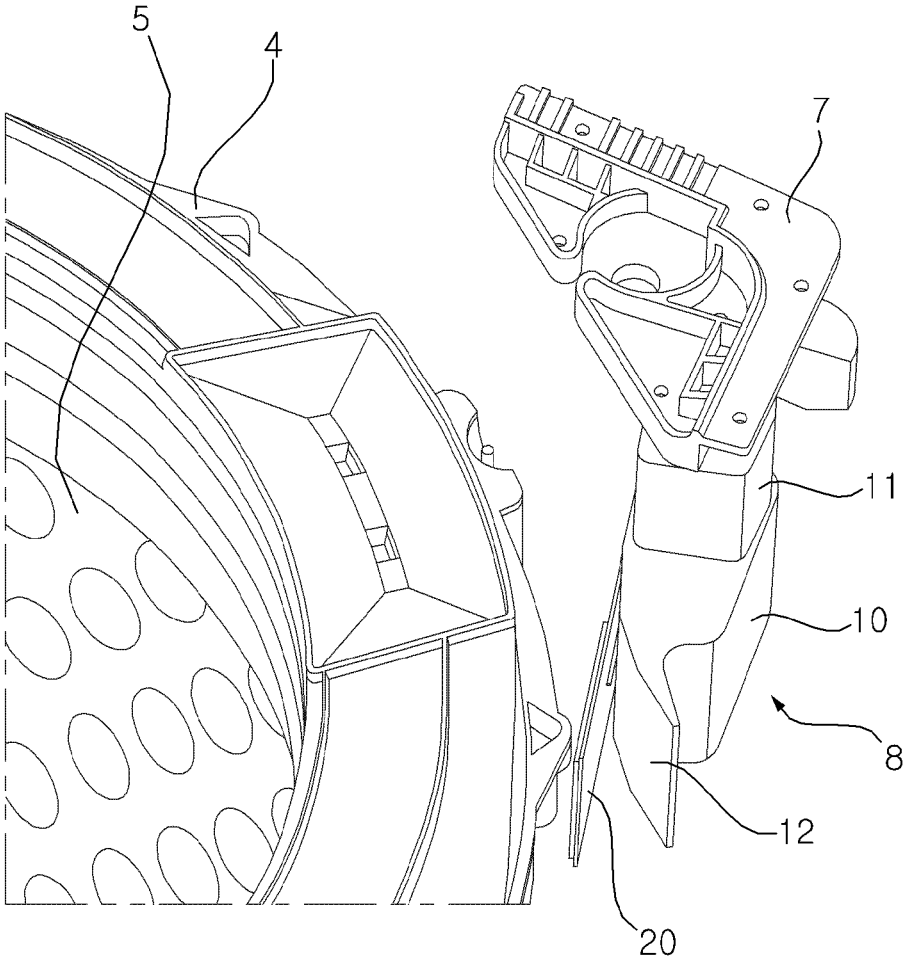
FIG. 2 is an enlarged perspective view illustrating a configuration of the vibration limiter according to an embodiment of the present invention.
Figure 3:
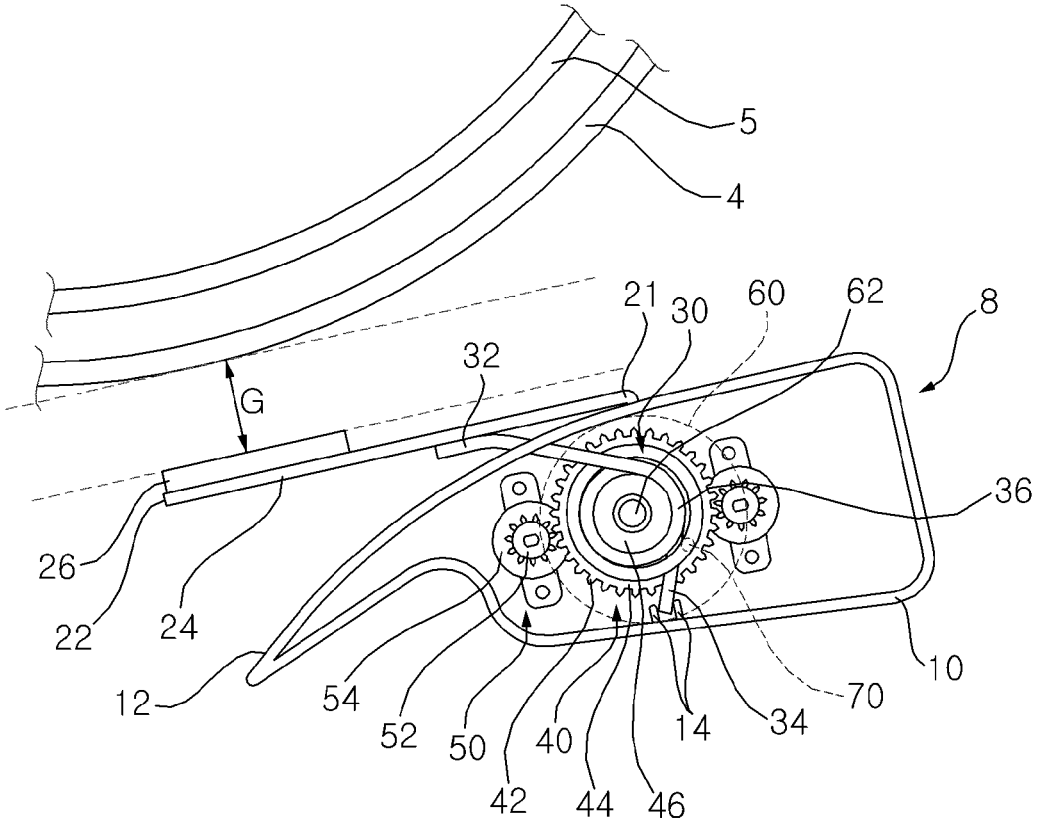
FIG. 3 is a plan view illustrating an inner configuration of the vibration limiter according to the illustrated embodiment of the present invention in a state in which the tub does not contact the vibration limiter.
Figure 4:
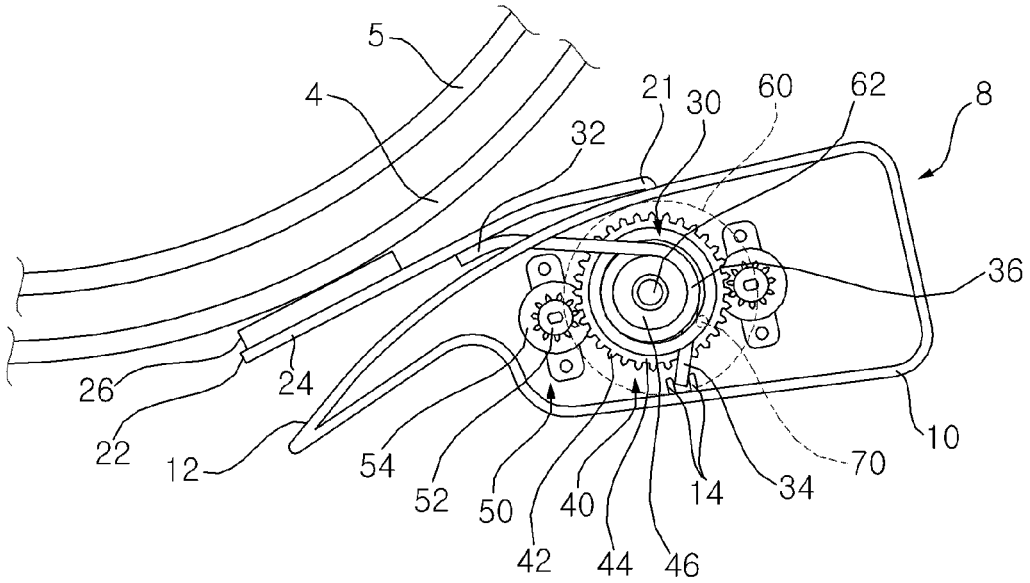
FIG. 4 is a plan view illustrating the inner configuration of the vibration limiter according to the illustrated embodiment of the present invention in a state in which the tub contacts the vibration limiter.

FIG. 2 is an enlarged perspective view illustrating a configuration of the vibration limiter according to an embodiment of the present invention. FIG. 3 is a plan view illustrating an inner configuration of the vibration limiter according to the illustrated embodiment of the present invention in a state in which the tub does not contact the vibration limiter. FIG. 4 is a plan view illustrating the inner configuration of the vibration limiter according to the illustrated embodiment of the present invention in a state in which the tub contacts the vibration limiter.

As illustrated in FIGS. 2 to 4, the vibration limiter 8 includes a housing 10 installed at one of the cabinet 2 and tub 4, and a contact plate 20 disposed within the housing 10 such that the contact plate 20 comes into contact with the other of the cabinet 2 and tub 4 when the tub 4 vibrates. The vibration limiter 8 also includes a spring 30 for elastically supporting the contact plate 20, a rotating member 40 rotatable by at least one of the spring 30 and contact plate 20, and an oil damper 50 engaged with the rotating member 40.

When the housing 10 is installed at the cabinet 2, the tub 4 contacts the contact plate 20 and, as such, may vary the shape of the contact plate 20 or the position of at least a portion of the contact plate 20. On the other hand, when the housing 10 is installed at the tub 4, the contact plate 20 may vibrate together with the tub 4 while contacting the cabinet 2 and, as such, the shape of the contact plate 20 or the position of at least a portion of the contact plate 20 may be varied. When the shape or position of the contact plate 20 varies, the spring 30 may absorb impact caused by contact of the tub 4. In this case, the rotating member 40 may be rotated by the spring 30 and, as such, the oil damper 50 may be operatively connected to the rotating member 40, thereby absorbing impact together with the spring 30 while minimizing operational noise.

The housing 10 may protect the spring 30, rotating member 40, and oil damper 50. The housing 10 may be disposed to face the top of the tub 4. When the housing 10 is installed at the cabinet 2, it may be mounted to each hanger pivot 7 mounted to the cabinet 2. The housing 10 may be elongated in forward and rearward directions or left and right directions. When the vibration limiter 8 functions to limit vibration of the tub 4 in left and right directions, the housing 10 thereof may be mounted to the hanger pivot 7, to be elongated in forward and rearward directions. On the other hand, when the vibration limiter 8 functions to limit vibration of the tub 4 in forward and rearward directions, the housing 10 thereof may be mounted to the hanger pivot 7, to be elongated in left and right directions. The housing 10 may include a round portion 12, which is curved in a direction that the contact plate 20 is bent by the tub 4. The round portion 12 secures a space to allow the contact plate 20 to be deformed without interference during deformation thereof. The round portion 12 may be formed to have a convex shape. Impact of the housing 10 against the tub 4 may be minimized by the round portion 12. The round portion 12 may also minimize damage of the housing 10 when excessive vibration of the tub 4 occurs. The housing 10 may be mounted to the hanger pivot 7 via a level adjusting member 11 to eliminate a level difference between the hanger pivot 7 and the tub 4 when such a level difference is generated. The level adjusting member 11 may be upwardly protruded from the housing 10 in an integrated state. Alternatively, the level adjusting member 11 may be manufactured separately from the housing 10, and may be coupled to the hanger pivot 7 and housing 10. The level adjusting member 11 may be disposed between the hanger pivot 7 and the housing 10. The level adjusting member 11 may function as a fixing and supporting rod to fix the housing 10 to the hanger pivot 7. The housing 10 may be formed with a horizontally elongated spring hole, through which the spring 20 extends horizontally.

When the housing 10 is installed at the cabinet 2, the contact plate 20 may be disposed at the housing 10 such that there is a gap G between the contact plate 20 and the tub 4. On the other hand, when the housing 10 is installed at the tub 4, the contact plate 20 may be disposed at the housing 10 such that there is a gap between the contact plate 20 and the cabinet 2. When the tub 4 vibrates, the contact plate 20 may be struck by the tub 4. When the tub 4 moves to a position where the tub 4 is spaced apart from the contact plate 20, as illustrated in FIG. 2, the contact plate 20 may be elastically recovered to an original shape thereof. The contact plate 20 may include a plate 24 having one end as a connecting end connected to the housing 10, and the other end as a free end 22. The plate 24 may have elasticity so that the plate 24 may be recovered to an original shape thereof when external force caused by the tub 4 is released from the plate 24. The plate 24 may be made of an aluminum material. The plate 24 may have a rectangular plate shape elongated in forward and rearward directions or in left and right directions. The plate 24 may be fixed, at the connecting end 21 thereof, to the housing 10 by bonding means such as an adhesive or other fastening means such as screws. The position of the free end 22 of the plate 24 may be varied in accordance with a variation in the position of the tub 4. When the tub 4 strikes the contact plate 20, the free end 22 of the plate 24 is moved toward the cabinet 2. On the other hand, when the tub 4 does not contact the contact plate 20, the free end 22 of the plate 24 is maintained at a position spaced apart from the cabinet 2. The contact plate 20 may further include a damping member 26 provided at one surface of the plate 24 facing the tub 4. When the tub 4 directly strikes the plate 24, noise may be generated due to impact generated due to the strike. On the other hand, when the tub 4 strikes the damping member 26, the damping member 26 may absorb impact generated due to the strike and noise generated due to the impact. The damping member 26 may be installed to be closer to the free end 22 of the plate 24 than to the connecting end 21 of the plate 24. The damping member 26 may be made of an elastic material such as sponge or rubber. The plate 24 is mounted to the housing 10 in the form of a cantilever. The plate 24 is also elastically supported by the spring 30 and, as such, may absorb vibration of the tub 4.

When the shape of the plate 24 is varied due to vibration and impact, the spring 30 may absorb the vibration and impact. The spring 20 may have a contact portion 32 to contact the plate 24. The contact portion 32 may contact the plate 24 at a position closer to the connecting end 21 of the plate 24 fixed to the housing 10 than to the free end 22 of the plate 24. The spring 30 may include a support portion 34 supported by the housing 10, to prevent the spring 30 from running idle in the housing 10 during shape variation of the plate 24. The housing 10 may be formed with a spring fitting portion 14, in which the support portion 34 is fitted. The spring 30 may absorb vibration in a state in which the support 34 is fitted in the spring fitting portion 14. The spring 30 may include a torsion spring having one end supported by the housing 10 and the other end contacting the contact plate 20. The torsion spring may be fixed to one of a plate body 44 and a rotating shaft 46, which are included in the rotating member 40, as will be described later. The torsion spring may include a coil portion 36 wound in the form of a coil between the ends of the torsion spring. The coil portion 36 may be fixed to one of the plate body 44 and rotating shaft 46 of the rotating member 40.

The rotating member 40 may include the plate body 44, which is formed, at an outer circumferential surface thereof, with gear teeth 42 engaged with the oil damper 50, and the rotating shaft 46, which is protruded from the plate body 44. The rotating member 40 may be rotatably disposed within the housing 10 so as to rotate about the rotating shaft 46. The plate body 44 may be rotatably placed on a bottom wall of the housing 10. At least a portion of the rotating shaft 46 may be disposed within the coil portion 36 of the torsion spring. The coil portion 36 of the torsion spring may be elastically deformed around the rotating shaft 46. The rotating member 40 may function as a vibration transfer member to transfer, to the oil damper 50, impact transferred from the tub 4 to the contact plate 20 and spring 30. The rotating member 40 may actuate the oil damper 50 in order to make the oil damper 50 function as a damper.

The oil damper 50 may be installed at the housing 10. The oil damper 50 may be constituted by a gear damper having a gear to be rotated by the rotating member 40. The oil damper 50 may include a gear 52 engaged with the gear teeth 42 of the rotating member 40, and a damper body 54 to rotatably support the gear 52. In the illustrated case, two oil dampers 50 are provided. The following description will be given in conjunction with one oil damper 50, for simplicity of description. The oil damper 50 may absorb vibration by a principle different than that of the spring 30. The oil damper 50 contains oil therein and, as such, may absorb vibration energy by viscosity resistance of oil generated during rotation of the gear 52. The vibration limiter 8 of the washing machine may more effectively absorb vibration through complementary action of vibration absorption according to elastic deformation of the spring 30 and vibration absorption according to viscosity resistance of oil.

The vibration limiter 8 may further include a gap adjusting mechanism 60 for adjusting the gap G between the tub 4 and the contact plate 20 by rotating the rotating member 40. When the wash tub rotates at low speed, as in a washing operation, the cap adjusting mechanism 60 may adjust the gap G such that the gap G is narrowed, as compared to a spin-drying operation. On the other hand, when the wash tub rotates at high speed, as in the spin-drying operation, the cap adjusting mechanism 60 may adjust the gap G such that the gap G is widened, as compared to the washing operation. During low-speed rotation of the wash tub, the gap adjusting mechanism 60 may rotate the rotating member 40 such that the contact plate 20 is maintained at a position toward the tub 40. On the other hand, during high-speed rotation of the wash tub, the gap adjusting mechanism 60 may rotate the rotating member 40 such that the contact plate 20 is maintained at a position away from the tub 40. When the gap G is narrowed, it may be possible to prevent the tub 4 from striking the cabinet 2. On the other hand, when the gap G is widened, it may be possible to prevent the tub 4 from frequently striking the contact plate 20 due to vibration thereof. The gap adjusting mechanism 60 may be constituted by a motor, an actuator, or the like, which is connected to the rotating member 40. The gap adjusting mechanism 60, which may be a motor, an actuator, or the like, may include a drive shaft 62 to rotate the rotating member 40. The gap adjusting mechanism 60 may be connected to the rotating shaft 46 of the rotating member 40. The drive shaft 62 is directly connected to the rotating shaft 46 of the rotating member 40, to rotate the rotating member 40. Alternatively, the gap adjusting mechanism 60 may rotate the rotating member 40 through connection of the drive shaft 62 to the rotating shaft 46 of the rotating member 40 or the plate body 44 of the rotating member 40 via various power transmission members such as gears.

The vibration limiter 8 may include an unbalance sensor 70 to detect a position of at least one of the spring 30 and rotating member 40. When the tub 4 exhibits great unbalance, shape variation of the contact plate 20, namely, bending degree of the contact plate 20, may be great, and rotation angle of the rotating member 40 caused by the spring 30 may also be great. On the other hand, when the tub 4 exhibits small unbalance, shape variation of the contact plate 20, namely, bending degree of the contact plate 20, may be small, and rotation angle of the rotating member 40 caused by the spring 30 may also be small. When the unbalance sensor 70 senses a rotating angle of the rotating member 40, unbalance of the tub 4 may be detected. The unbalance sensor 70 may include a magnet installed at one of the spring 30 and rotating member 40, and a Hall sensor installed at the housing 10, to sense the magnet. Alternatively, the unbalance sensor 70 may include a magnet installed at the housing 10, and a Hall sensor installed at one of the spring 30 and rotating member 40.

When the sensing value sensed by the unbalance sensor 70 during operation of the washing machine is high, the washing machine may execute a laundry untangling operation to untangle laundry or a laundry spin-drying operation to spin-dry laundry. When the washing machine rotates in a highly unbalanced state, the tub 4 may continuously strike the cabinet 2. When the washing machine is controlled in accordance with an unbalance value sensed by the vibration limiter 8 in this case, it may be possible to minimize a phenomenon in which the tub 4 frequently strikes the cabinet 2. In particular, when the unbalance sensor 70 is operatively connected to the gap adjusting mechanism 60, it may be possible to minimize vibration while minimizing the phenomenon in which the tub 4 frequently strikes the cabinet 2.

Figure 5:
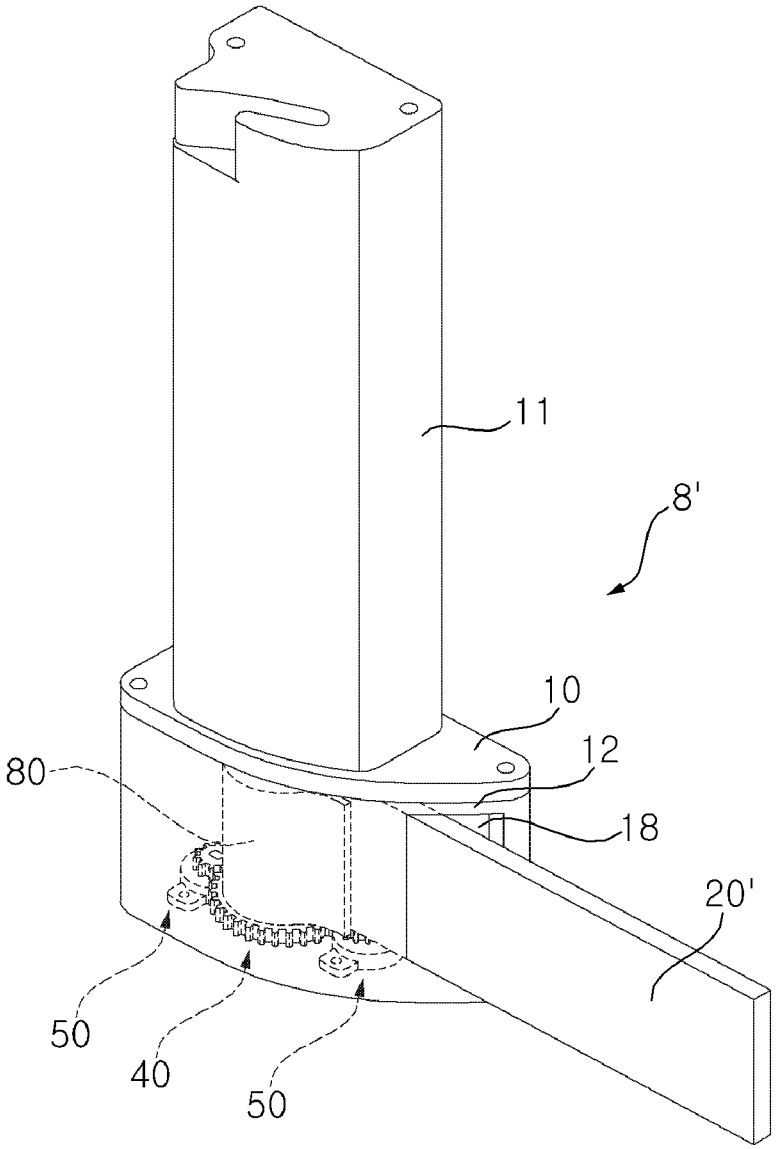
FIG. 5 is a perspective view illustrating a configuration of the vibration limiter according to another embodiment of the present invention.
Figure 6:
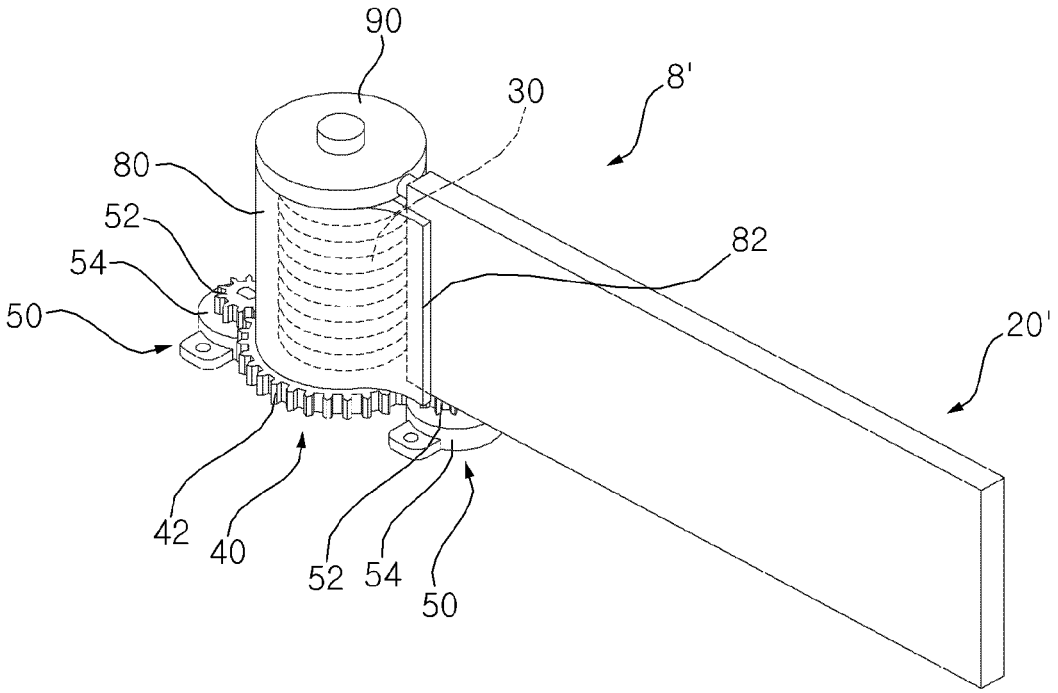
FIG. 6 is an enlarged perspective view illustrating an inner configuration of the vibration limiter according to the illustrated embodiment of the present invention.

FIG. 5 is a perspective view illustrating a configuration of the vibration limiter according to another embodiment of the present invention. FIG. 6 is an enlarged perspective view illustrating an inner configuration of the vibration limiter according to the illustrated embodiment of the present invention.

The vibration limiter according to this embodiment, which is designated by reference numeral 8', may include the housing 10, a contact plate 20', the spring 30, the rotating member 40, and the oil damper 50, as in the previous embodiment. The contact plate 20' may extend through the housing 10 without being connected to the housing 10. The vibration limiter 8' may further include a spring casing 80 disposed within the rotating member 40 while being coupled to the contact plate 20', to protect the spring 30.

The housing 10 may be formed with a through hole 18, through which the contact plate 20' extends. The through hole 18 may be elongated in a bending direction of the contact plate 20'. The through hole 18 may be formed at the round portion 12. The constituent elements of the housing 10, except for the through hole 18, may be identical or similar to those of the previous embodiment and, as such, are designated by the same reference numerals as those of the previous embodiment, and no detailed description thereof will be given.

The contact plate 20' has one end connected to the spring casing 80 while extending through the housing 10, and the other end as a free end disposed outside the housing 10.

The spring 30 may contact a portion of the contact plate 20' disposed within the housing 10. Other constituent elements of the spring 30 and functions thereof are identical or similar to those of the previous embodiment and, as such, the constituent elements are designated by the same reference numerals as those of the previous embodiment, and no detailed description thereof will be given.

Constituent elements of the rotating member 40 and oil damper 50 are identical or similar to those of the previous embodiment and, as such, the constituent elements are designated by the same reference numerals as those of the previous embodiment, and no detailed description thereof will be given.

The spring casing 80 may enclose the spring 30, to protect the spring 30. The spring casing 80 may be formed with a contact plate coupling portion 82 to be coupled with the portion of the contact plate 20' disposed within the housing 10. The spring casing 80 may be formed with a spring through hole, through which the spring 30 extends. As in the previous embodiment, the spring 30 may include a support portion 34 supported by the housing 10.

The vibration limiter 8' according to this embodiment may further include a spring cover 90 disposed above the spring 30. The spring cover 90 may be disposed on a top of the spring casing 80, to protect the spring 30 together with the spring casing 80.

Figure 7:
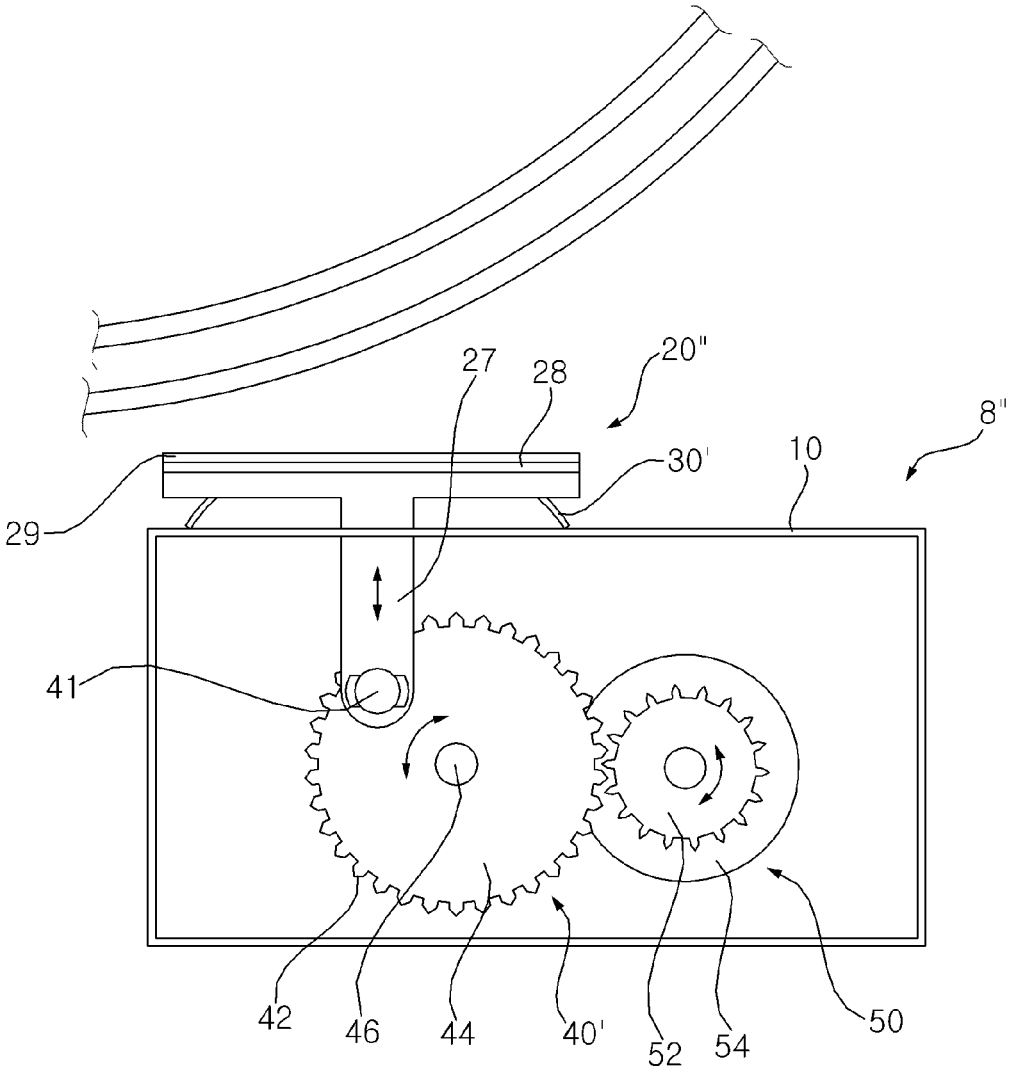
FIG. 7 is a plan view illustrating an inner configuration of the vibration limiter according to another embodiment of the present invention.

FIG. 7 is a plan view illustrating an inner configuration of the vibration limiter according to another embodiment of the present invention.

The vibration limiter according to this embodiment, which is designated by reference numeral 8", may include the housing 10, a contact plate 20", a spring 30', a rotating member 40', and the oil damper 50, as in the previous embodiments. The contact plate 20" may extend through the housing 10 without being connected to the housing 10. The contact plate 20" may be connected to the rotating member 40.

The housing 10 may be formed with a through hole, through which the contact plate 20" extends. The constituent elements of the housing 10, except for the through hole, may be identical or similar to those of the previous embodiments and, as such, are designated by the same reference numerals as those of the previous embodiments, and no detailed description thereof will be given.

The contact plate 20" may include a connecting rod 27 connected to the rotating member 40', and a plate body 28 disposed on the connecting rod 27. The connecting rod 27 may extend through the housing 10. A portion of the connecting rod 27, which is disposed within the housing 10, may be rotatably connected to the plate body 44 of the rotating member 40. The connecting rod 27 may be pushed toward the rotating member 40 due to vibration of the tub 4. As a result, the rotating member 40 may be rotated by the connecting rod 7. The plate body 28 may be mounted to the connecting rod 27, to be disposed between the tub 4 and the connecting rod 27. The contact plate 20" may further include a damping member 29 mounted to one surface of the plate body 28 facing the tub 4. The damping member 29 may absorb impact generated due to strike of the tub 4 and noise generated due to the impact, as in the damping member in the previous embodiments.

The spring 30' may be disposed outside the housing 10, differently than the previous embodiments. The spring 30" may extend from the plate body 28 such that it contacts the housing 10 or is disposed between the connecting rod 27 and the housing 10. When the tub 4 presses the contact plate 20" toward the housing 10, the spring 30' may absorb vibration while being elastically deformed. When external force applied to the contact plate 20" is released, the spring 30' may return the contact plate 20" to an original position thereof. The spring 30' may include a plate spring integrated with the plate body 28 while extending from the plate body 28 toward the housing 10, or a coil spring disposed between the connecting rod 27 and the housing 10.

The rotating member 40' may include a rotating shaft, to which the connecting rod 27 is rotatably connected. The constituent elements of the rotating member 40', except for the configuration to connect the connecting rod 27, may be identical or similar to those of the previous embodiments and, as such, are designated by the same reference numerals as those of the previous embodiments, and no detailed description thereof will be given.

The oil damper 50 may absorb vibration during rotation of the rotating member 40' by a principle different than that of the spring 30.

The vibration limiter 8" of the washing machine may more effectively absorb vibration through complementary action of vibration absorption according to elastic deformation of the spring 30' disposed outside the housing 10 and vibration absorption according to viscosity resistance of oil in the oil damper 50 disposed within the housing 10.

As apparent from the above description, the oil damper according to the present invention complementarily acts with the spring, to effectively absorb vibration. Accordingly, it may be possible to reduce the size of the spring and to secure enhanced reliability even after prolonged use.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A washing machine comprising:

a cabinet defining the appearance of the washing machine;

an outer tub, hung within the cabinet, for containing wash water;

a wash tub rotatably disposed in the outer tub; and a vibration limiter for limiting vibration of the outer tub while the wash tub rotates, the vibration limiter comprising:

a housing disposed at one of the cabinet and the outer tub;

a contact plate connected to the housing, and being bent about a connection portion with the housing by a contact with the other of the cabinet and the outer tub;

a torsion spring having an end fixed at the housing and an opposite end supporting the contact plate;

a rotating member rotatably disposed in the housing; and an oil damper engaged with the rotating member, wherein the torsion spring is engaged with the rotating member such that the rotating member is rotated as the torsion spring is elastically deformed when the contact plate is bent.

2. The washing machine according to claim 1, wherein the vibration limiter further comprises:

a gap adjusting mechanism for adjusting a gap between the other of the cabinet and the outer tub and the contact plate by rotating the rotating member.

3. The washing machine according to claim 2, wherein the gap adjusting mechanism is connected to a rotating shaft of the rotating member.

4. The washing machine according to claim 1, further comprising:

an unbalance sensor for detecting a position of at least one of the torsion spring and the rotating member.

5. The washing machine according to claim 1, wherein the housing has a curved contour corresponding to a bent shape of the contact plate, at a portion facing the contact plate.

6. The washing machine according to claim 1, wherein the oil damper is disposed in the housing.

7. The washing machine according to claim 1, wherein the contact plate comprises:

a plate having opposite ends, one of the opposite ends connected to the housing and the other of the opposite ends being a free end; and a damping member disposed on a surface of the plate which faces the other of the cabinet and the outer tub.

8. The washing machine according to claim 7, wherein the damping member is located to be closer to the free end than to the end connected to the housing.

9. The washing machine according to claim 1, wherein the rotating member comprises a plate body formed, at an outer circumferential surface thereof, with gear teeth engaged with the oil damper, and a rotating shaft protruded from the plate body.

10. The washing machine according to claim 9, wherein the torsion spring is fixed to one of the plate body and the rotating shaft.

11. The washing machine according to claim 1, wherein the housing is disposed at the cabinet, wherein the housing is disposed at a location corresponding to a top of the wash tub.

12. The washing machine according to claim 1, wherein the housing is arranged such that the contact plate is contact with the other of the cabinet and the outer tub in response to a displacement of the outer tub in forward and rearward directions or in left and right directions.

13. A washing machine comprising:

a cabinet defining the appearance of the washing machine;

an outer tub, hung within the cabinet, for containing wash water;

a wash tub rotatably disposed in the outer tub;

a hanger pivot fixed at the cabinet;

a hanger for suspending the outer tub inside the cabinet, connected to the hanger pivot; and a vibration limiter for limiting vibration of the outer tub while the wash tub rotates, the vibration limiter comprising:

a housing;

a rotating member rotatably disposed in the housing;

a contact plate extended from the housing and contact with the outer tub when the wash tub rotates, the contact plate pivotably disposed about a rotation axis of the rotating member;

a torsion spring disposed in the housing and elastically deformed when the contact plate is pivoted by a contact of the outer tub; and a leveling adjusting member protruded from the housing in an upward direction and connected to the hanger pivot.

14. The washing machine according to claim 13, wherein the vibration limiter further comprises a spring casing within which the torsion spring is disposed, the spring casing being disposed on the rotating member and coupled to the contact plate.

15. The washing machine according to claim 13, wherein the housing is formed with a through hole, through which the contact plate penetrates.

16. A washing machine comprising:

a cabinet defining the appearance of the washing machine;

an outer tub, hung within the cabinet, for containing wash water;

a wash tub rotatably disposed in the outer tub; and a vibration limiter for limiting vibration of the outer tub while the wash tub rotates, the vibration limiter comprising:

a housing disposed at one of the cabinet and the outer tub;

a rotating member rotatably disposed in the housing:

a contact plate including a plate body which is disposed outside of the housing and moved toward the housing by an external force applied from the outer tub when the outer tub vibrates, and a connecting rod which is extended from the plate body and pivotably connected to the rotating member to rotate the rotating member according to the movement of the plate body;

a spring disposed between the housing and plate body to elastically support the plate body; and an oil damper engaged with the rotating member.

17. The washing machine according to claim 16, wherein the spring extends from the plate body and contacts the housing.

18. The washing machine according to claim 16, wherein the contact plate further comprises a damping member disposed at a surface of the plate body which faces the tub.

* * * * *